US011283221B2

(12) United States Patent
Hsueh et al.

(10) Patent No.: US 11,283,221 B2
(45) Date of Patent: Mar. 22, 2022

(54) CONNECTOR

(71) Applicant: SPEED TECH CORPORATION, Taoyuan (TW)

(72) Inventors: ChengHsiang Hsueh, Taoyuan (TW); ITing Hsieh, Taoyuan (TW); HuaChun Chang, Taoyuan (TW)

(73) Assignee: SPEED TECH CORPORATION, Taoyuan (TW)

( * ) Notice: Subject to any disclaimer, the term of this patent is extended or adjusted under 35 U.S.C. 154(b) by 3 days.

(21) Appl. No.: 17/094,169

(22) Filed: Nov. 10, 2020

(65) Prior Publication Data

US 2021/0151939 A1 May 20, 2021

(30) Foreign Application Priority Data

Nov. 14, 2019 (CN) ..... 201911111163.6

(51) Int. Cl.

| | |
|---|---|
| ***H01R 13/648*** | (2006.01) |
| ***H01R 13/6585*** | (2011.01) |
| ***H01R 13/514*** | (2006.01) |
| ***H01R 13/6599*** | (2011.01) |

(52) U.S. Cl.

CPC ..... *H01R 13/6585* (2013.01); *H01R 13/514* (2013.01); *H01R 13/6599* (2013.01)

(58) Field of Classification Search

CPC ..... H01R 13/514; H01R 13/6585; H01R 13/6586; H01R 13/6587; H01R 13/6599

USPC ..... 439/607.01, 607.05

See application file for complete search history.

(56) References Cited

U.S. PATENT DOCUMENTS

2021/0151939 A1* 5/2021 Hsueh ..... H01R 13/6599

FOREIGN PATENT DOCUMENTS

| | | | |
|---|---|---|---|
| CN | 1401147 | A | 3/2003 |
| CN | 204720596 | U | 10/2015 |
| CN | 205122833 | U | 3/2016 |
| CN | 205141283 | U | 4/2016 |
| CN | 207320485 | U | 5/2018 |
| CN | 110086026 | A | 8/2019 |
| TW | M515214 | U | 1/2016 |

* cited by examiner

*Primary Examiner* — Khiem M Nguyen

(74) *Attorney, Agent, or Firm* — Birch, Stewart, Kolasch & Birch, LLP

(57) ABSTRACT

The present disclosure a connector including an insulating body, a number of terminal modules and a shielding member. The insulating body includes a base and a mating portion protruding from the base. The terminal modules are installed in the insulating body. The terminal modules include a first signal terminal module and a ground terminal module. The first signal terminal module includes a first insulating block and a first signal terminal. The ground terminal module includes an insulation block and a ground terminal. The first signal terminal and the ground terminal are respectively provided with a first contact portion and a ground contact portion. The first insulating block and the insulation block are provided with through holes communicating with each other. The shielding member is inserted in the through holes to be coupled with the ground terminal.

17 Claims, 12 Drawing Sheets

CONNECTOR

CROSS-REFERENCE TO RELATED APPLICATION

This patent application claims priority of a Chinese Patent Application No. 201911111163.6, filed on Nov. 14, 2019 and titled "CONNECTOR", the entire content of which is incorporated herein by reference.

TECHNICAL FIELD

The present disclosure relates to a connector, in particular to a high-speed connector.

BACKGROUND

High-speed connectors need to ensure that the data transmission between the signal terminals is free from external interference during signal transmission to improve the quality of data transmission. In order to solve the above-mentioned technical problem, some connectors are provided with ground plates near the signal terminals to prevent signal cross-talk. However, these ground plates are spaced apart and arranged separately, which does not facilitate to achieve a better shielding effect.

SUMMARY

An object of the present disclosure is to provide a connector with a better shielding effect.

In order to achieve the above object, the present disclosure adopts the following technical solution: a connector including an insulating body, a plurality of terminal modules and a shielding member. The insulating body includes a base and a mating portion protruding from the base. The base has a receiving cavity. The mating portion includes a mating surface and a slot extending through the mating surface and communicating with the receiving cavity. The terminal modules are installed in the receiving cavity of the insulating body. The terminal modules include a first signal terminal module and a ground terminal module. The first signal terminal module includes a first insulating block and a first signal terminal fixed in the first insulating block. The ground terminal module includes an insulation block and a ground terminal fixed in the insulation block. The first signal terminal and the ground terminal are respectively provided with a first contact portion and a ground contact portion extending into the slot. The first insulating block and the insulation block are provided with through holes communicating with each other. The shielding member is inserted in the through holes to be coupled with the ground terminal.

Compared with the prior art, the present disclosure can reduce signal cross-talk and achieve a better shielding effect by providing a shielding member for coupling with the ground terminal.

DETAILED DESCRIPTION

Referring to FIGS. 1 to 12, the present disclosure discloses a connector 100 including an insulating body 1 and a plurality of terminal modules 2 installed in the insulating body 1. A mating connector (not shown) for mating with the connector 100 is inserted into the connector 100 along a mating direction A.

Figure 6:
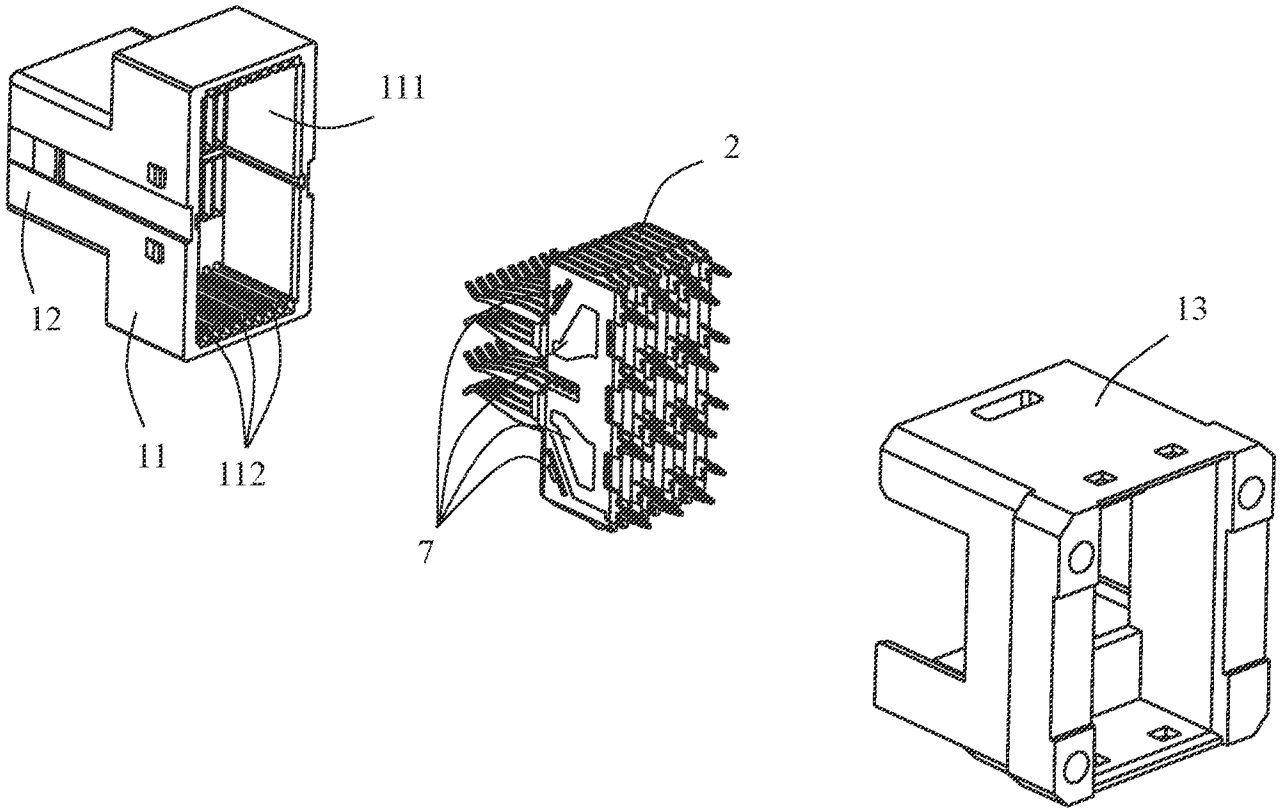
FIG. 6 is a further perspective exploded view of FIG. 5.

The insulating body 1 includes a base 11, a mating portion 12 protruding from the base 11 and a housing 13 assembled outside of the base 11. Referring to FIG. 6, the base 11 includes a receiving cavity 111 for receiving the plurality of terminal modules 2 and a plurality of mounting slots 112 communicating with the receiving cavity 111. In the illustrated embodiment of the present disclosure, the mounting slots 112 are used to guide and position the terminal modules 2.

Figure 1:
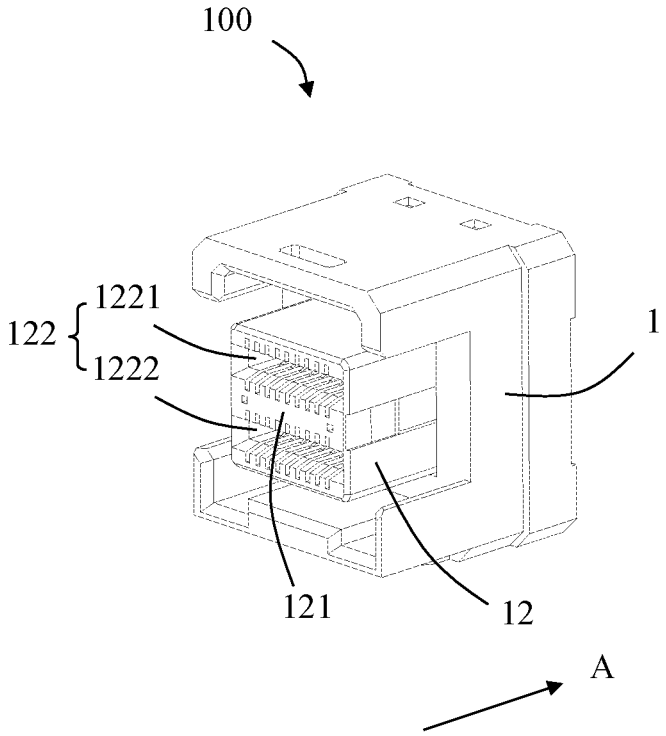
FIG. 1 is a perspective view of a connector in accordance with an embodiment of the present disclosure.
Figure 2:
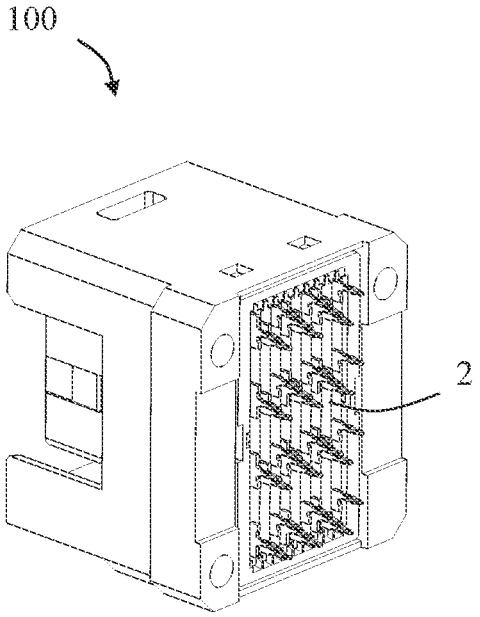
FIG. 2 is a perspective schematic view of FIG. 1 from another angle.
Figure 3:
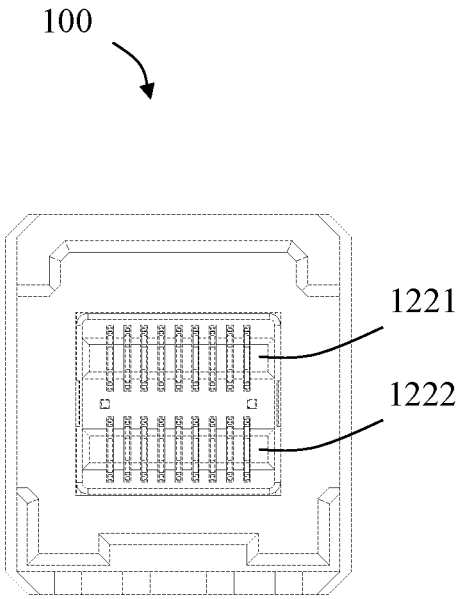
FIG. 3 is a front view of FIG. 1.

Referring to FIG. 1, the mating portion 12 includes a mating surface 121 and a slot 122 extending through the mating surface 121 and communicating with the receiving cavity 111. In the illustrated embodiment of the present disclosure, the slot 122 includes a first slot 1221 and a second slot 1222 located below the first slot 1221. The first slot 1221 and the second slot 1222 are used for receiving tongue plates (not shown) of the mating connector.

Figure 4:
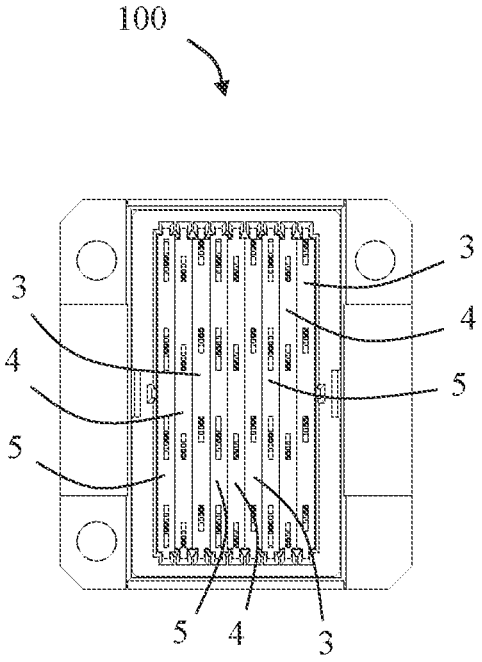
FIG. 4 is a rear view of FIG. 1.
Figure 5:
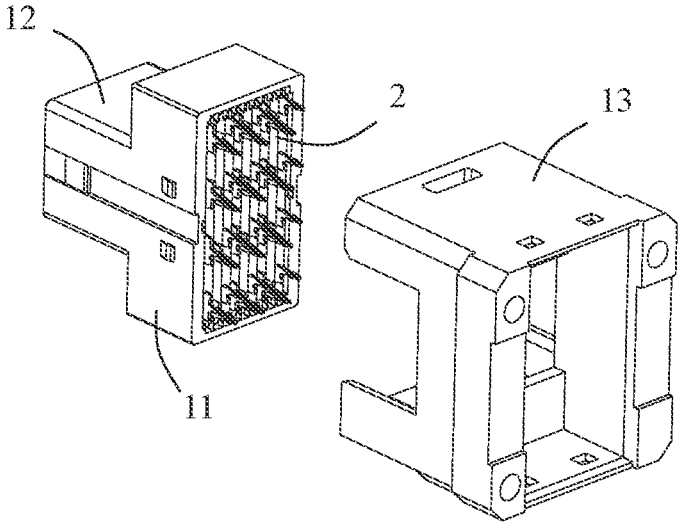
FIG. 5 is a partially exploded perspective view of FIG. 2.
Figure 7:
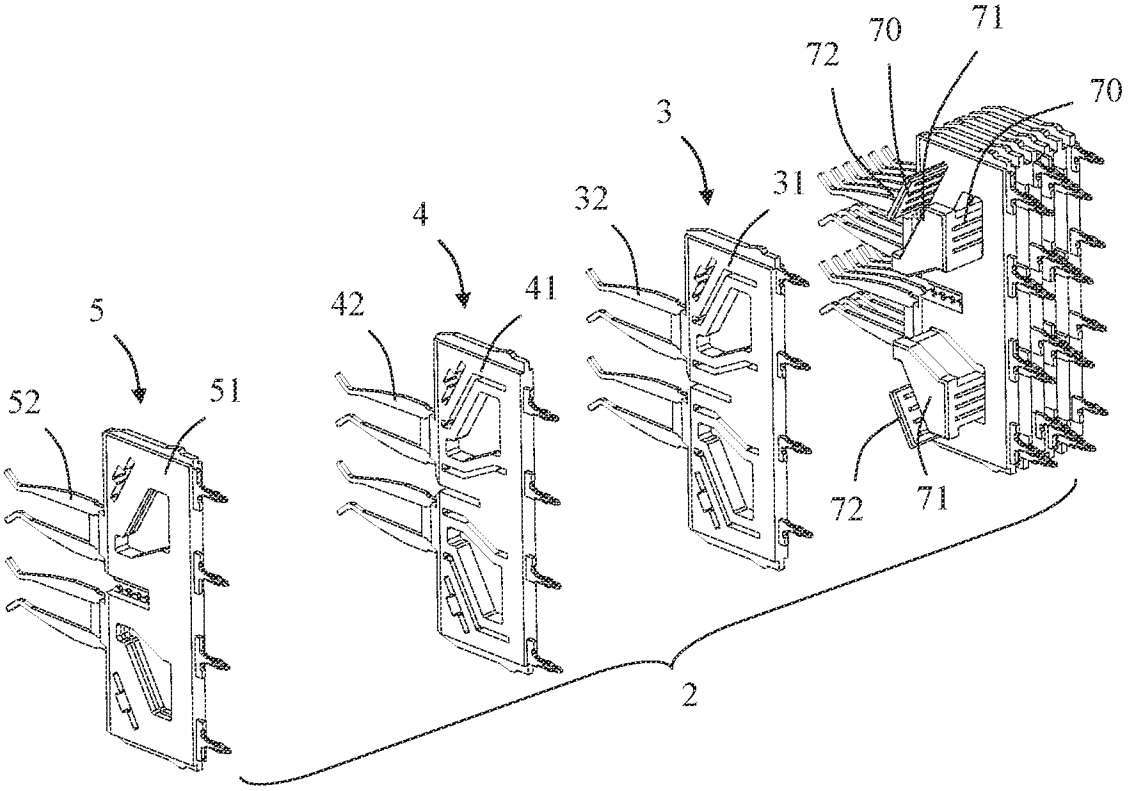
FIG. 7 is a perspective schematic view of terminal modules in FIG. 6 with one terminal module being exploded.
Figure 8:
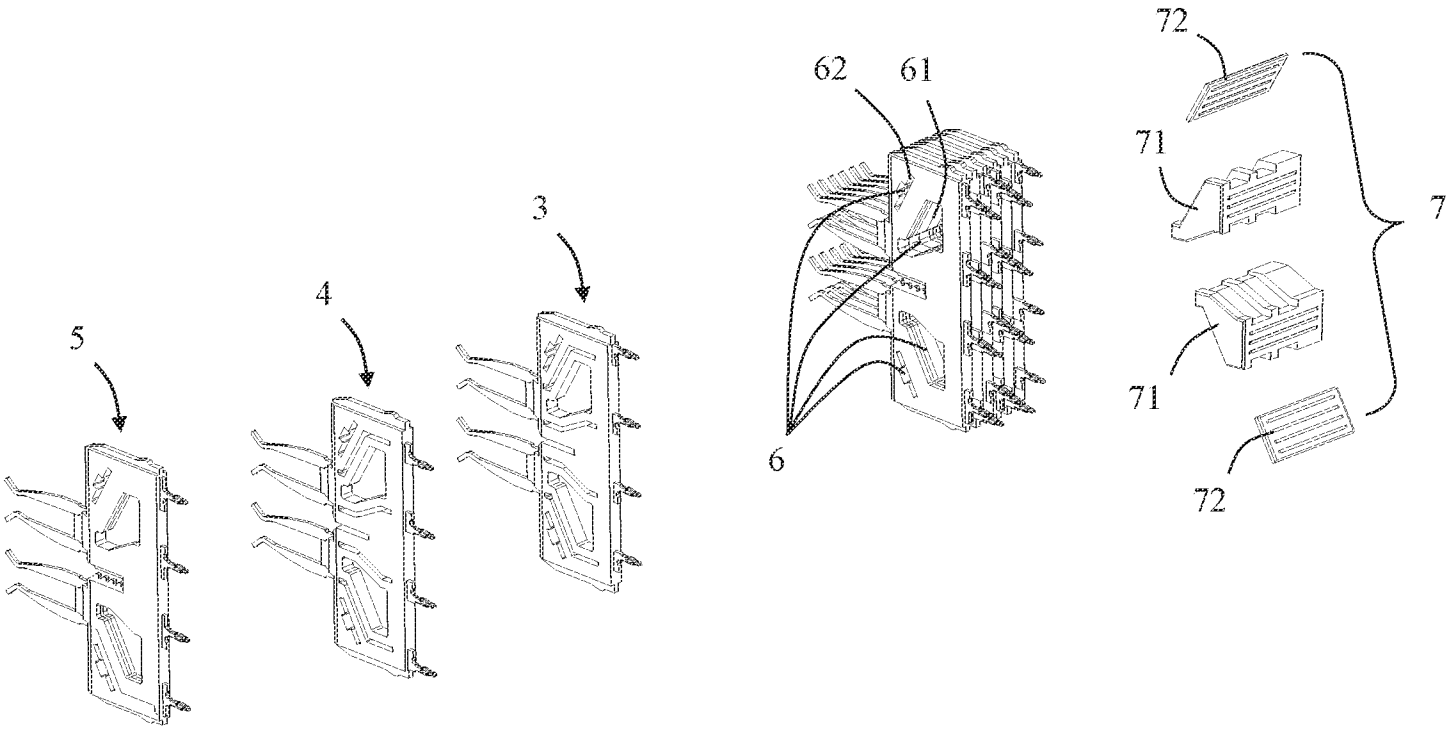
FIG. 8 is a further perspective exploded view of FIG. 7.

Referring to FIG. 4, in the illustrated embodiment of the present disclosure, the plurality of terminal modules 2 include three groups of the terminal modules 2 which are arranged side by side and have the same structure. Referring to FIG. 7, each terminal module 2 includes a first signal terminal module 3, a second signal terminal module 4 and a ground terminal module 5. The first signal terminal module 3 includes a first insulating block 31 and a plurality of first signal terminals 32 fixed in the first insulating block 31. The second signal terminal module 4 includes a second insulating block 41 and a plurality of second signal terminals 42 fixed in the second insulating block 41. The ground terminal module 5 includes a third insulating block/insulation block 51 and a ground terminal 52 fixed in the third insulating block 51.

Specifically, referring to FIGS. 7 to 11, in an embodiment of the present disclosure, the plurality of first signal terminals 32 are insert-molded in the first insulating block 31 to form a wafer. The plurality of second signal terminals 42 are insert-molded in the second insulating block 41 to form a wafer. The ground terminal 52 is insert-molded in the third insulating block 51 to form a wafer. This arrangement facilitates assembling the terminal modules 2 to the insulating body 1 along the corresponding mounting slots 112.

Figure 11:
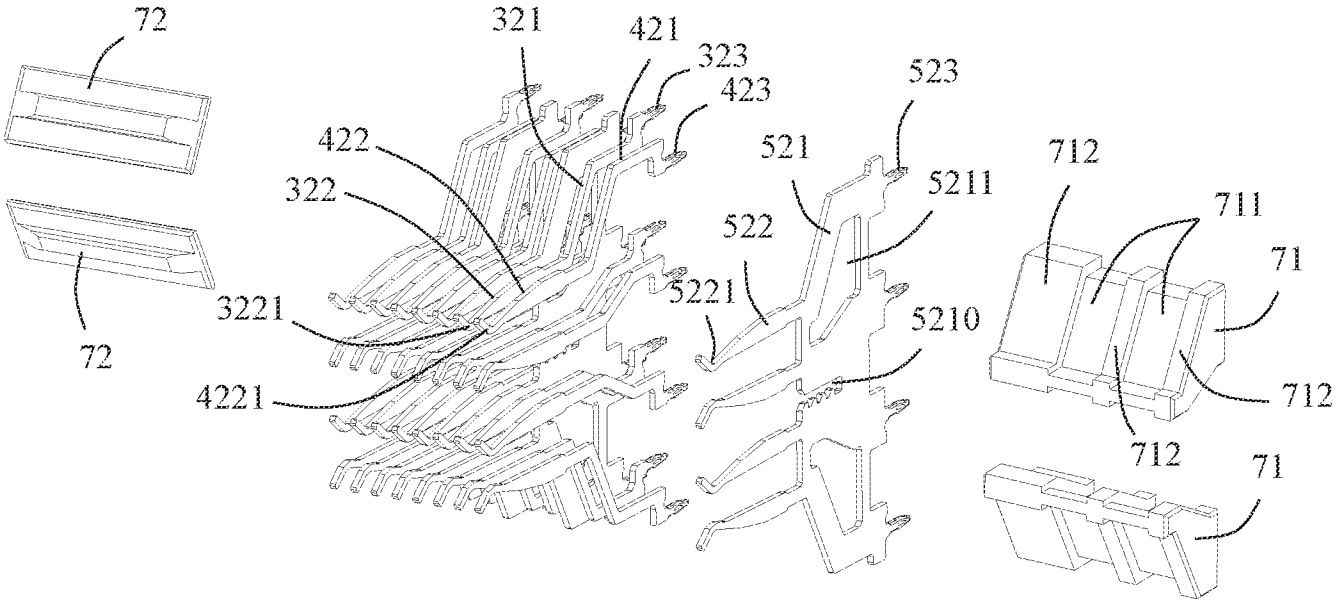
FIG. 11 is a partially exploded perspective view of FIG. 10.

Specifically, referring to FIG. 11, each wafer formed by the first signal terminals 32 has four first signal terminals 32 which are arranged at intervals. Each of the first signal terminals 32 includes a first intermediate portion 321, a first contact arm 322 extending from the first intermediate portion 321 in a direction opposite to the mating direction A, and a first tail portion 323 extending from the first intermediate portion 321 along the mating direction A. The first contact arm 322 is provided with a first contact portion 3221 extending into the slot 122. The first tail portions 323 are used to electrically connect with a circuit board.

Each wafer formed by the second signal terminals 42 includes four second signal terminals 42 which are arranged at intervals. Each of the second signal terminals 42 includes a second intermediate portion 421, a second contact arm 422 extending from the second intermediate portion 421 in the direction opposite to the mating direction A, and a second tail portion 423 extending from the second intermediate portion 421 along the mating direction A. The second contact arm 422 is provided with a second contact portion 4221 extending into the slot 122. The second tail portions 423 are used to electrically connect with the circuit board.

The first signal terminals 32 and the second signal terminals 42 form a plurality of differential pairs to increase data transmission speed. In the illustrated embodiment of the present disclosure, the four first signal terminals 32 and the four second signal terminals 42 are divided into two groups and extend into the first slot 1221 and the second slot 1222, respectively.

Figure 9:
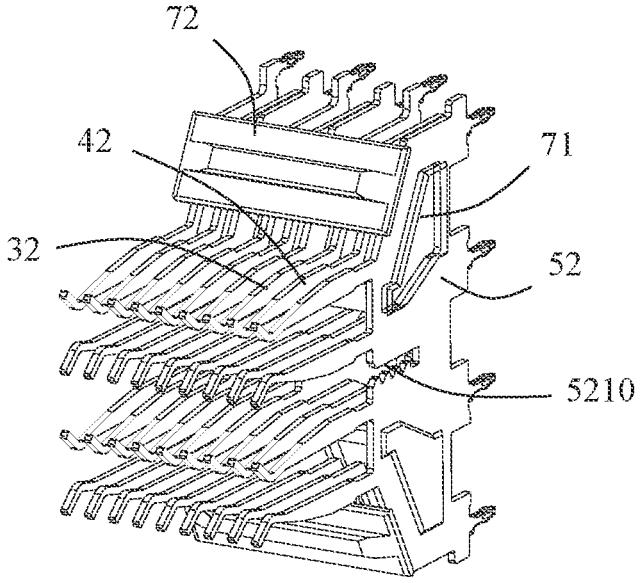
FIG. 9 is a perspective schematic view of the terminal module in FIG. 6 after the first insulating block, the second insulating block and the third insulating block are removed.
Figure 10:
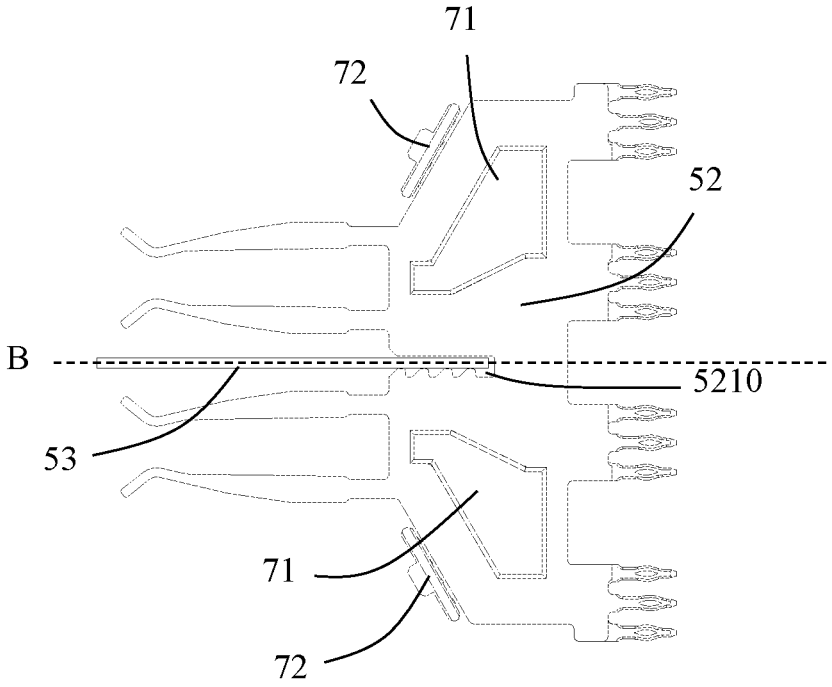
FIG. 10 is a side view of FIG. 9 after a ground plate is assembled.

Each wafer formed by the ground terminal 52 is stamped from a sheet of metal. The ground terminal 52 includes a main body 521, a plurality of third contact arms 522 extending from the main body 521 in the direction opposite to the mating direction A, and a plurality of third tail portions 523 extending from the main body 521 along the mating direction A. Each third contact arm 522 is provided with a third contact portion/ground contact portion 5221 extending into the slot 122. The third tail portions 523 are used to electrically connect with the circuit board. Referring to FIG. 9, the main body 521 is provided with a groove 5210 at a front end thereof. Referring to FIG. 10, the connector 100 further includes a ground plate 53 inserted and fixed in the groove 5210 to connect all the ground terminals 52 into a whole. This arrangement can increase the grounding area and improve the grounding effect. In some embodiments, the ground plate 53 is a single sheet and is integrally made of a metal material. In some embodiments, the connector 100 may not have a ground plate 53, and a shielding member (as described hereinafter) may be used to reduce signal cross-talk.

Referring to FIGS. 6 to 11, the first insulating block 31, the second insulating block 41 and the third insulating block 51 are provided with through holes 6 communicating with each other. The connector 100 is also provided with a shielding member 7 inserted in the through holes 6 to be coupled with the ground terminals 52 to reduce signal cross-talk. The phrase "be coupled with" includes, but is not limited to, different elements actually contact each other to produce electrical connection, or different elements have no physical contact with each other but the distance between each other is small enough to produce electrical connection.

Referring to FIGS. 7 to 10, in the illustrated embodiment of the present disclosure, the through holes 6 and the shielding member 7 includes multiple parts. In the illustrated embodiment of the present disclosure, referring to FIG. 10, the through holes 6 and the shielding member 7 are symmetrically arranged along a middle plane B between the first slot 1221 and the second slot 1222.

Figure 12:
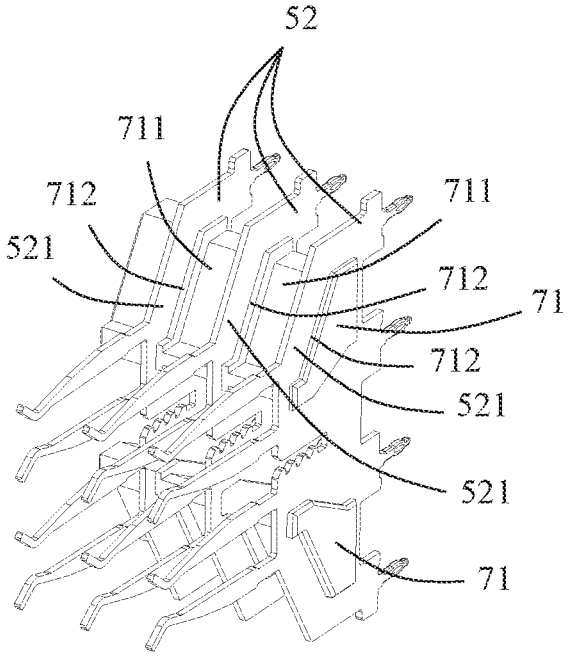
FIG. 12 is a perspective schematic view when a plurality of ground terminals are in mating with a first shielding member.

Specifically, taking only the through holes 6 and the shielding member 7 on one side of the middle plane B as an example, the through holes 6 include a first through hole 61 and a second through hole 62 extending through the first insulating block 31, the second insulating block 41 and the third insulating block 51. The shielding member 7 includes a first shielding member 71 inserted in the first through hole 61 and a second shielding member 72 inserted in the second through hole 62. The first shielding member 71 and the second shielding member 72 have different structures. Referring to FIGS. 11 and 12, in the illustrated embodiment of the present disclosure, the first shielding member 71 is provided with a plurality of recesses 711 on its surface and a plurality of ribs 712 adjacent to the recesses 711. The recesses 711 correspond to the first intermediate portions 321 of the first signal terminals 32 and the second intermediate portions 421 of the second signal terminals 42. This enables the first intermediate portions 321 and the second intermediate portions 421 to maintain a sufficiently large gap with the first shielding member 71 to prevent coupling. At the same time, the plurality of ribs 712 correspond to the main bodies 521 of the ground terminals 52, so that distances between the ribs 712 and the corresponding main bodies 521 are small enough to realize the coupling therebetween. The second shielding member 72 has a flat plate shape and is arranged obliquely.

Referring to FIGS. 9 to 11, in the illustrated embodiment of the present disclosure, the main body 521 is provided with a first relief hole 5211 communicating with the first through hole 61. The first through hole 61 transversely extends through adjacent first intermediate portions 321 of adjacent first signal terminals 32 and adjacent second intermediate portions 421 of adjacent second signal terminals 42. As shown in FIG. 11, in terms of the relative position of the first shielding member 71 and the second shielding member 72, the second shielding member 72 is located at an outer side of the first intermediate portion 321, the second intermediate portion 421 and the main body 521, and the first shielding member 71 is located at inner side of the first intermediate portion 321, the second intermediate portion 421 and the main body 521. This arrangement makes use of internal spaces of the terminal modules 2 and realizes the installation of the shielding member 7 without increasing the size of the terminal modules 2. In an embodiment of the present disclosure, the embodiment in which the shielding member 7 is inserted into the through holes 6 may be such that the shielding member 7 contacts the ground terminals 52 and does not contact the first signal terminals 32 and the second signal terminals 42 of the terminal modules 2. This arrangement enables the shielding member 7 to be in contact with the ground terminals 52 to achieve a better shielding effect. At the same time, the shielding member 7 is not electrically connected to the first signal terminals 32 and the second signal terminals 42 to prevent signal interference. Of course, in other embodiments (not shown), another embodiment in which the shielding member 7 is inserted into the through holes 6 may also be that the shielding member 7 and the ground terminals 52 have small distances but are not in contact with each other. Through electrical coupling, the shielding member 7 can still be electrically connected to the ground terminals 52 to achieve a shielding effect. At the same time, the shielding member 7 does not contact the first signal terminals 32 and the second signal terminals 42 to prevent signal interference. In other words, the shielding member 7 is closer to the ground terminals 52 than the first signal terminals 32 and the second signal terminals 42, and the distances between the shielding member 7 and the ground terminals 52 are small enough to be electrically connected to each other. However, the spacing between the shielding member 7 and the first signal terminals 32 and the spacing between the shielding member 7 and the second signal terminals 42 are large enough to avoid being electrically connected to each other.

In the illustrated embodiment of the present disclosure, the shielding member 7 is made of a conductive plastic, but is not limited to the conductive plastic. In other embodiments, the shielding member 7 may also be made of other conductive materials or include other conductive materials, such as metals, alloys, and the like. The shielding member 7 may also be made of or include electromagnetic loss materials or wave absorbing materials.

In the illustrated embodiment of the present disclosure, the shielding member 7 is provided with an abutting structure to cooperate with the ground terminals 52. Referring to FIG. 7, in the illustrated embodiment of the present disclosure, the abutting structure includes a rib 70 provided on the shielding member 7 to improve the contact with the ground terminals 52 and achieve a good grounding effect.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A connector, comprising:

an insulating body comprising a base and a mating portion protruding from the base, the base having a receiving cavity, the mating portion comprising a mating surface and a slot extending through the mating surface and communicating with the receiving cavity; and a plurality of terminal modules installed in the receiving cavity of the insulating body, the plurality of terminal modules comprising a first signal terminal module and a ground terminal module, the first signal terminal module comprising a first insulating block and a first signal terminal fixed in the first insulating block, the ground terminal module comprising an insulation block and a ground terminal fixed in the insulation block, the first signal terminal and the ground terminal being respectively provided with a first contact portion and a ground contact portion extending into the slot, the first insulating block and the insulation block being provided with through holes communicating with each other; wherein the connector further comprises a shielding member inserted in the through holes to be coupled with the ground terminal.

2. The connector according to claim 1, wherein the plurality of terminal modules further comprise a second signal terminal module, the second signal terminal module comprises a second insulating block and a second signal terminal fixed in the second insulating block, the second signal terminal is provided with a second contact portion extending into the slot, and the through holes extend through the second insulating block.

3. The connector according to claim 2, wherein the shielding member is made of a conductive plastic, and the shielding member does not contact the first signal terminal and the second signal terminal.

4. The connector according to claim 3, wherein the shielding member contacts the ground terminal.

5. The connector according to claim 4, wherein the shielding member is provided with an abutting structure which matches with the ground terminal.

6. The connector according to claim 5, wherein the abutting structure includes a rib provided on the shielding member.

7. The connector according to claim 3, wherein the shielding member does not contact the ground terminal, and the shielding member is closer to the ground terminal than the first signal terminal and the second signal terminal.

8. The connector according to claim 2, wherein the through holes comprise a first through hole transversely extending through the first insulating block, the second insulating block and the insulation block, and the shielding member comprises a first shielding member inserted in the first through hole.

9. The connector according to claim 8, wherein the through holes comprise a second through hole transversely extending through the first insulating block, the second insulating block and the insulation block, the shielding member comprises a second shielding member inserted in the second through hole, and the first shielding member and the second shielding member have different structures.

10. The connector according to claim 9, wherein the first shielding member comprises a recess formed on its surface and a rib adjacent to the recess, the recess corresponds to the first signal terminal and the second signal terminal, and the rib corresponds to the ground terminal.

11. The connector according to claim 9, wherein the ground terminal comprises a main body, a third contact arm extending from the main body in a direction opposite to a mating direction, and a third tail portion extending from the main body along the mating direction, the ground contact portion is located on the third contact arm, the main body is provided with a first relief hole communicating with the first through hole, and the first shielding member is also inserted in the first relief hole.

12. The connector according to claim 11, wherein a plurality of the ground terminals are provided, each main body is provided with a groove, and the connector further comprises a ground plate inserted and fixed in the grooves to connect all the ground terminals into a whole.

13. The connector according to claim 11, wherein the first signal terminal module comprises a plurality of the first signal terminals arranged at intervals, each of the first signal terminals comprises a first intermediate portion, a first contact arm extending from the first intermediate portion in a direction opposite to the mating direction, and a first tail portion extending from the first intermediate portion along the mating direction, the first contact portion is located on the first contact arm, and the first through hole transversely extends through two adjacent first intermediate portions.

14. The connector according to claim 13, wherein the second signal terminal module comprises a plurality of the second signal terminals arranged at intervals, each of the second signal terminals comprises a second intermediate portion, a second contact arm extending from the second intermediate portion in the direction opposite to the mating direction, and a second tail portion extending from the second intermediate portion along the mating direction, the second contact portion is located on the second contact arm, and the first through hole transversely extends through two adjacent second intermediate portions.

15. The connector according to claim 14, wherein the second shielding member is located at an outer side of the first intermediate portion, the second intermediate portion and the main body, and the first shielding member is located at an inner side of the first intermediate portion, the second intermediate portion and the main body.

16. The connector according to claim 2, wherein the slot comprises a first slot and a second slot located below the first slot, four first signal terminals are provided and insert-molded in the first insulating block, four second signal terminals are provided and insert-molded in the second insulating block, the four first signal terminals and the four second signal terminals are divided into two groups and extend into the first slot and the second slot, respectively.

17. The connector according to claim 16, wherein the through holes and the shielding member are symmetrically arranged along a middle plane between the first slot and the second slot.

* * * * *